United States Patent [19]

Cramer et al.

[11] 4,002,039

[45] Jan. 11, 1977

[54] SELF-REGULATING CRYOSTAT

[75] Inventors: Robert L. Cramer; James A. Mientus, both of Davenport, Iowa

[73] Assignee: The Bendix Corporation, South Bend, Ind.

[22] Filed: Aug. 28, 1975

[21] Appl. No.: 608,421

[52] U.S. Cl. ..... 62/224; 62/514 JT; 236/102

[51] Int. Cl.[2] ..... F25B 19/00

[58] Field of Search ..... 62/224, 514 JT; 236/101, 93, 102

[56] References Cited

UNITED STATES PATENTS

| | | | |
|---|---|---|---|
| 2,786,713 | 3/1957 | Donaldson | 236/102 X |
| 2,979,952 | 4/1961 | Eastman | 236/101 R X |
| 3,320,755 | 5/1967 | Jepsen et al. | 62/514 JT |
| 3,719,322 | 3/1973 | Gifford | 236/102 |
| 3,818,720 | 6/1974 | Campbell | 62/514 JT |

*Primary Examiner*—William E. Wayner
*Attorney, Agent, or Firm*—Leo H. McCormick, Jr.; William N. Antonis

[57] ABSTRACT

In a cryogenic cooler, wherein a fluid under pressure is transmitted through an expansion orifice in a nozzle into an expansion chamber at a rate which is controlled by the movement of a needle valve in the expansion chamber, an expander member extends from the nozzle and carries the needle valve. The expander member expands and contracts in response to the temperature in the expansion chamber at a different rate than the needle valve to automatically regulate the flow of fluid into the expansion chamber.

10 Claims, 3 Drawing Figures

SELF-REGULATING CRYOSTAT

BACKGROUND OF THE INVENTION

In cryogenic coolers, which utilize the Joule-Thomson effect of cooling a fluid to its liquefraction temperature, a gas under pressure is passed through a nozzle into an expansion chamber. To conserve gas, once the liquefraction temperature has been reached, it is necessary to provide a control valve for regulating the flow of gas through the expansion nozzle. In U.S. Pat. No. 3,517,525, a vapor bulb located in the expansion chamber is connected to a bellows. The bellows holds a needle valve in alignment with the expansion nozzle. As the temperature in the expansion chamber changes, fluid in the vapor bulb correspondingly reacts and allows the bellows to change the position of the needle valve with respect to the expansion nozzle. Unfortunately, the regulation of the needle valve through the operation of the bellows is directly dependent upon the reliability of the vapor bulb. A variety of operational and manufacturing conditions can cause microscopic cracks in the vapor bulb allowing some of the fluid to escape. Although leakage through such microscopic cracks may be of a magnitude too minute to detect by normal production means, failure can occur within one year of shelf-life and less while in use. Once the fluid has escaped from the vapor bulb, the bellows fails to proportionally control the movement of the needle valve as a function of the change in temperature in the expansion chamber.

Later, as disclosed in U.S. Pat. No. 3,827,252, the vapor bulb was replaced with a means to permit gases of different thermal characteristics to be communicated into a bellows and with the gas in the expansion chamber develop an appropriate expanson and contraction rate sufficient to control the flow of gas into the expansion chamber. Unfortunately, the distance that the bellows move the needle valve can create an alignment problem with the orifice which results in improper regulation.

Additionally, U.S. Pat. No. 3,457,730 discloses a valve regulator for a cooler utilizing the Joule-Thomson principle having a temperature sensing element which responds to the temperature differential between the surrounding atmosphere and the expansion chamber. Unfortunately for successful self-regulation, the valve regulator must rapidly sense and respond to changes in temperature in the expansion chamber. In an attempt to increase the effectiveness of this temperature sensing element, fluid from the expansion chamber was communicated essentially throughout the entire length of the cooler. Unfortunately, the temperature of the surrounding atmosphere can continually change resulting in an unstable control. In addition, with the needle valve mounted in the cantilever support it is possible to develop an internal bending movement which can also add to the instability of the control.

SUMMARY OF THE INVENTION

We have devised a control for regulating the flow of fluid from an orifice of a nozzle means in a direct relationship to the difference between the coefficient of expansion of an expander means and a needle valve located in an expansion chamber. A first leg and a second leg of the expander means which are attached to an end plate extend into the expansion chamber and are connected to a mounting means. The mounting means has an axial opening into which a bushing means is located. The bushing means has an eccentric axial opening into which the needle valve is located. The bushing means is rotated until the needle valve is aligned with the orifice of the nozzle means. When the fluid flows through the orifice, it expands in the expansion chamber to reduce the temperature therein. As the temperature in the expansion chamber changes, the needle valve and the expander means contracts and expands at different rates to automatically regulate the flow through the orifice to maintain the temperature in the expansion chamber within a predetermined range.

It is therefore the object of this invention to provide a cryogenic cooling apparatus with control means having a valve for automatically regulating the flow of fluid through an orifice of a nozzle in a direct relationship to only the temperature in an expansion chamber.

It is another object of this invention to provide a cryogenic cooling apparatus with an expander means for moving a needle valve as a function of the expander means and the needle valve to maintain the temperature in an expansion chamber within a predetermined range.

It is another object of this invention to regulate the operation of a needle valve means by the expansion and contraction of an expander means to proportionally regulate the flow of fluid through an orifice of a nozzle into an expansion chamber in response to changes in temperature of the fluid therein.

It is still a further object of this invention to provide a cryogenic cooling apparatus having a needle valve which is aligned with an orifice of a nozzle by the movement of an eccentric bushing means fixed to a mounting member.

These and other objects will be apparent from reading this specification and viewing the drawing.

DETAILED DESCRIPTION OF THE PREFERRED EMBODIMENT

Figure 1:
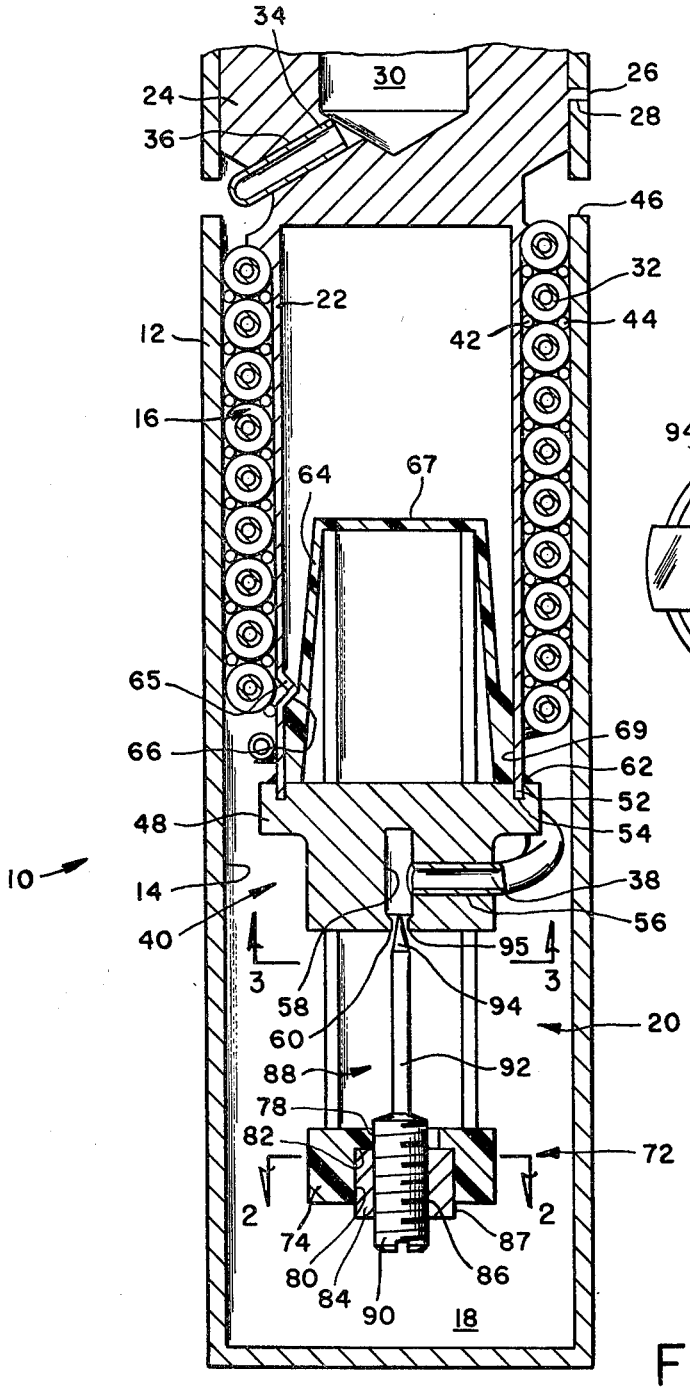
FIG. 1 is a sectional view of a cryogenic cooler having an automatic control valve for regulating the flow of fluid through a nozzle means to cool a chamber by isenthalpic expansion of the fluid.
Figure 3:
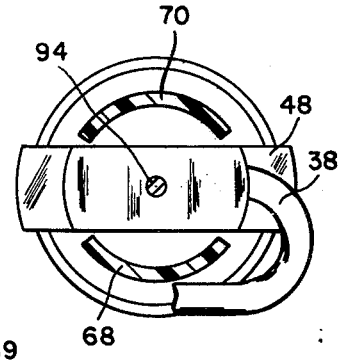
FIG. 3 is a sectional view taken along line 3—3 of FIG. 1 showing the relationship between the nozzle means and the expansion means.
Figure 2:
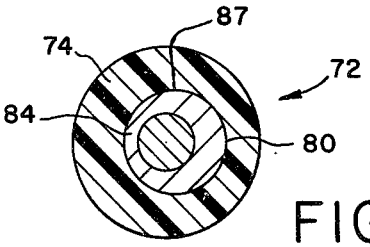
FIG. 2 is a sectional view taken along line 2—2 of FIG. 1 showing the adjustment means for aligning a needle valve means with an orifice of the nozzle means.

The cryogenic cooling apparatus 10 shown in FIG. 1 has an insulated dewar housing 12 with a cylindrical bore 14 contained therein. A heat exchanger fluid distribution means 16 is located within the bore 14 to supply an expansion chamber 18 with fluid under pressure. The fluid under pressure isenthalpically expands in chamber 18 to produce cooling therein through liquefraction of at least a portion of the fluid, in accordance with the Joule-Thomson principle.

A control means 20 is located within the expansion or temperature regulation chamber 18 to automatically regulate the flow of fluid from the distribution means 16 to maintain the temperature within the chamber 18 at the liquefraction temperature with a minimum quantity of fluid under pressure.

The heat exchanger fluid distribution means 16 includes a tubular mandrel 22 which extends from a cylindrical body 24 into the bore 14 until projection 26 engages shoulder 28 on the dewar housing 12. The cylindrical body 24 has axial passage 30 which is connected to a source of fluid under pressure.

A finned tube means 32 has a first end 34 which extends through passage 36 into axial passage 30 of the cylindrical body 24 and a second end 38 which is secured to nozzle means 40. The finned tube means 32 is spirally wound around the tubular mandrel 22 from the first end 34 to the second end 38. A first cord 42 is located adjacent the tubular mandrel 22 and a second cord 44 is located adjacent the bore 14 to form a flow path from the expansion chamber 18 around the finned tube to the exit slots 46 in the dewar housing 12.

The nozzle means 40 has a solid base 48 which extends into the interior of the tubular mandrel 22 until the end 52 of the tubular mandrel 22 engages the bottom of groove 54. End 38 of the finned tube means is located in passage 56 which in turn is connected to the blind axial bore 58. The axial bore 58 has an orifice 60 through which fluid is communicated into the expansion chamber 18. The nozzle means is positively secured to the tubular mandrel 22 by a bead of weld 62 to prevent any movement therebetween.

A support means 64 has wall with a shoulder 66 thereon which is held against a series of indentations or stop 65 in the tubular mandrel 22 by the base 48 of the nozzle means 40. The support means 64 has a closed end 67 and a peripheral surface 69 on the wall which separates and seals the expansion chamber 18 from the interior of the tubular mandrel 22.

The control means 20 has a first leg 68 and a second leg 70 each having a first end which is rigidly fixed to the closed end 67 of the support means 64 and a second end which is secured to an arcuate segment of the mounting means 72. The mounting means 72 has a cylindrical body 74 with a stepped axial bore having a first diameter 78 and a second diameter 80 separated by a shoulder 82. A bushing means 84, located in the second diameter 80, has a threaded opening 86 eccentrically positioned with respect to the second diameter 80. A needle valve means 88 has a threaded section 90 to which stem 92 is attached. The threaded section 90 is adjusted in the threaded opening 86 to bring face 94 into engagement with orifice 60. Surface 87 of the bushing means 84 is then rotated with respect to the second diameter 80 to positively align face 94 in the center of the orifice 66. Surface 87 and the cylindrical body 74 are then fused together either by welding or through the use of an epoxy glue to maintain the axial alignment of the face 44 of needle valve means 88 and the orifice 66.

The nozzle means 40, the mounting means 72, and the needle valve means 88 are all constructed by materials having a relatively low coefficient of contraction and expansion while the support means 64 and attached first leg 68 and the second leg 70 are constructed of a material having a relatively high coefficient of expansion and contraction to develop relative movement between the needle valve means 88 and the orifice 66 and thereby regulation of fluid flow into the expansion chamber 18.

MODE OF OPERATION OF THE PREFERRED EMBODIMENT

When fluid under pressure (such as nitrogen) is present in axial bore 30 it flows into end 34 of the finned tube means 34 and out the orifice 66 into the expansion chamber 18. The face 94 on the end of stem 92 in conjunction with the orifice 60 controls the flow into the expansion chamber 18. The fluid under pressure upon passing from the orifice 60 expands in chamber 18 to cool the same. This fluid is now redirected in a flow path around the finned tube to precool the fluid flowing in the center thereof before exiting through slots 46 in the dewar housing 12.

As the fluid exiting from orifice 60 reduces the temperature in expansion chamber 18, the expansion or control means 20 and the steam 92 on the needle valve 88 reacts at a different rate of contraction or expansion. Since the nozzle means 40 and the needle valve 88 are constructed of the same material the relationship between face 94 and orifice 66 remains the same throughout the temperature range required to liquefy the fluid exiting from the orifice 60. As the temperature in the expansion chamber 18 is reduced from ambient to the liquefraction temperature, the first leg 68 and the second leg 70 correspondingly contracts such that face 94 is urged against seat 95 to interrupt the flow of fluid from the axial bore 62. The temperature of expansion chamber 18 tends to increase due to any heat inputs causing leg 68 and leg 70 to quickly respond by expanding to allow more fluid to flow into the expansion chamber 18 and again liquefy the fluid.

Thus, the expansion or control means 20, because of thermal coefficient of expansion, can automatically position the needle valve means 82 to regulate the minimum amount of fluid flowing through the orifice 66 and maintain the expansion chamber 18 at substantially the liquefraction temperature of the fluid. Additionally, the first leg 68 and the second leg 70 being positioned on opposite sides of the stem 92 assures that the movement of the face 94 will remains along an axial line with respect to the center of the orifice 66.

We claim:

1. A cryogenic cooling apparatus comprising:

a housing having a blind bore therein;

tubular means centrally located in said blind bore for establishing a temperature regulation chamber defined by the end thereof and the bottom of said blind bore;

nozzle means fixed to said tubular means in said temperature regulation chamber, said nozzle means having an orifice located therein;

finned tube means spirally wound around said tubular means, said tube means having an entrance port connected to a source of fluid under pressure and an exit port connected to said orifice;

support means located in said tubular means;

expander means having a first leg and a second leg fixed to said support means and extending into said temperature regulation chamber;

mounting means connecting said first leg with said second leg, said mounting means having an opening therein;

needle valve means connected to said mounting means and adapted to cooperate with said orifice in said nozzle means for controlling the flow of said fluid under pressure into said temperature regulation chamber in a manner to lower the temperature in the temperature regulation chamber, said first and second legs of the expander means expanding and contracting as a function of the temperature of the fluid in said temperature regulation chamber to proportionally regulate the flow of the fluid through said orifice; and bushing means located in said opening having an eccentric surface for aligning said needle valve in an axial position with said orifice in the nozzle means.

2. The cryogenic cooling apparatus, as recited in claim 1 wherein said mounting means further includes:

adjustment means for establishing an initial relationship between said needle valve means and said orifice, said needle valve means and said first and second legs of the expander means expanding and contracting at different rates to establish said control of the flow into temperature regulation chamber.

3. The cryogenic cooling apparatus, as recited in claim 2, wherein said nozzle means and said needle valve radially contract and expand at the same rate to reduce the possibility of friction occurring therebetween as a result of axial movement of the needle valve as a result of the difference of the rate of contraction and expansion with first and second legs of the expander means.

4. The cryogenic cooling apparatus, as recited in claim 1, wherein said support means includes:

wall means for separating said tubular means from the temperature regulation chamber to minimize the temperature of the fluid therein from being affected thereby by temperature conduction from the surrounding atmosphere through the tubular means.

5. The cryogenic cooling apparatus, as recited in claim 4, wherein said wall means further includes:

a peripheral surface thereon for engaging the interior of the tubular means for sealing the temperature regulation chamber from the interior of the tubular means, said peripheral surface having a shoulder thereon, said shoulder being positioned against a series of indentations on said tubular means by said nozzle means to fix the position of the support means with respect to the tubular means.

6. The cryogenic cooling apparatus, as recited in claim 5, wherein said wall means further includes:

a closed end to which one end of said first and second legs of the expander means are rigidly secured to allow the other end which is connected to the mounting means to move in an axial line without binding and thereby position the needle valve with respect to the orifice to provide a substantially immediate response to the temperature of the fluid in the temperature regulation chamber.

7. A cryogenic cooling apparatus comprising:

a housing having a blind bore therein;

a tube located in said blind bore;

support means connected to the end of the tube in said blind bore for establishing a temperature regulation chamber therebetween with the bottom of said blind bore;

nozzle means fixed to said tube in said temperature regulation chamber, said nozzle having an orifice located therein;

finned tube means spirally wound around said tube having an entrance port connected to a source of fluid under pressure and an exit port connected to said orifice;

expander means having a first leg and a second leg fixed to said support means and extending therefrom into said temperature regulation chamber;

mounting means connected to said first leg and second leg; and needle valve means connected to said mounting means having a stem extending toward said orifice in said nozzle meas, said first and second legs of the expander means expanding and contracting as a function of the temperature in the temperature regulation chamber to move said stem and proportionally regulate the fow of the fluid through said orifice to maintain the temperature in said temperature regulation chamber at a predetermined level.

8. The cryogenic cooling apparatus, as recited in claim 7, wherein said support means includes:

wall means having a peripheral surface for engaging the interior of said tube to seal the temperature regulation chamber from the interior of said tube, said peripheral surface having a shoulder therein, said nozzle means holding said shoulder against a stop on said tube to fix the position of said support means with respect to the end of said tube.

9. The cryogenic cooling apparatus, as recited in claim 8, wherein said wall means includes:

a closed end to which one end of each of said first and second legs is rigidly secured while the end of each of said legs extends into the temperature regulation chamber for holding the mounting means in alignment with the orifice, said first and second legs being located in the temperature regulation chamber to move said valve means with an immediate response to temperature changes therein.

10. The cryogenic cooling apparatus, as recited in claim 9, wherein said mounting means further includes:

bushing means located on said mounting means having an eccentric surface for axially aligning said stem with said orifice.

* * * * *